US010239593B2

(12) United States Patent
Karpinski

(10) Patent No.: US 10,239,593 B2
(45) Date of Patent: Mar. 26, 2019

(54) FENDER WITH BUILT-IN FENDER COVER USING FLOCKED MATERIAL

(71) Applicant: Taylor Made Group, LLC, Gloversville, NY (US)

(72) Inventor: David S. Karpinski, Ballston Spa, NY (US)

(73) Assignee: TAYLOR MADE GROUP, LLC, Gloversville, NY (US)

( * ) Notice: Subject to any disclaimer, the term of this patent is extended or adjusted under 35 U.S.C. 154(b) by 0 days.

(21) Appl. No.: 15/458,420

(22) Filed: Mar. 14, 2017

(65) Prior Publication Data

US 2017/0283018 A1 Oct. 5, 2017

Related U.S. Application Data

(60) Provisional application No. 62/317,945, filed on Apr. 4, 2016.

(51) Int. Cl.
*B63B 59/02* (2006.01)

(52) U.S. Cl.
CPC ..... *B63B 59/02* (2013.01); *B63B 2231/00* (2013.01)

(58) Field of Classification Search
CPC ... B63B 59/00; B63B 59/02; B63B 2059/025; E02B 3/20; E02B 3/24; E02B 3/26; E02B 3/28
See application file for complete search history.

(56) References Cited

U.S. PATENT DOCUMENTS

| | | | | |
|---|---|---|---|---|
| 4,843,994 | A | 7/1989 | Wilson et al. | |
| 4,996,936 | A | 3/1991 | Brundritt | |
| 5,849,390 | A | 12/1998 | Dillon | |
| 6,343,560 | B1 * | 2/2002 | Myers | B63B 1/121 114/354 |
| 6,863,010 | B2 | 3/2005 | Kent | |
| 7,721,667 | B2 | 5/2010 | Kaemmerling | |
| 9,038,556 | B2 | 5/2015 | Ulgen | |
| 2001/0008672 | A1 * | 7/2001 | Norvell | A41B 11/005 428/90 |
| 2010/0294187 | A1 * | 11/2010 | Greene | B63B 59/02 114/219 |
| 2016/0207596 | A1 * | 7/2016 | Solwold | B63B 59/02 |

FOREIGN PATENT DOCUMENTS

| | | | | |
|---|---|---|---|---|
| DE | 29720935 | * | 1/1998 | B63B 59/02 |
| WO | WO-0151221 | A1 * | 7/2001 | A47G 27/045 |

* cited by examiner

*Primary Examiner* — Andrew Polay
(74) *Attorney, Agent, or Firm* — Nixon & Vanderhye P.C.

(57) ABSTRACT

A boat fender includes a vinyl fender core that is sized and shaped for suspension adjacent a boat exterior to protect the boat exterior from damage resulting from impact with an obstacle. An integrated cover is secured to the fender core, such as by flocking.

3 Claims, 2 Drawing Sheets

FENDER WITH BUILT-IN FENDER COVER USING FLOCKED MATERIAL

CROSS-REFERENCES TO RELATED APPLICATIONS

This application claims the benefit of U.S. Provisional Patent Application No. 62/317,945, filed Apr. 4, 2016, the entire content of which is herein incorporated by reference.

STATEMENT REGARDING FEDERALLY SPONSORED RESEARCH OR DEVELOPMENT (Not Applicable)

BACKGROUND

The invention relates to boat fenders and, more particularly, to boat fenders including a built-in fender cover using a flock material.

Heavy duty fenders, particularly fenders for yachts and larger boats, have typically been manufactured of PVC or Hypalon material with welded or glued seams, webbing or d-ring straps at both ends and a valve for quick inflation and deflation. The vast majority of customers for this style fender purchase a separate fender cover, typically (but not always) made of double loop knit acrylic for use as a cover for the fender. The fender cover serves several purposes: (1) a soft surface to interface with the boat to limit dulling the gelcoat finish of the boat caused by the rubbing of PVC or Hypalon directly against the gelcoat; (2) a soft surface to cut down on the squeaking noise made when the boat and fender come in contact with each other (when living aboard, this is a nuisance); (3) to protect the PVC or Hypalon fender material from UV exposure, which causes the breakdown of the composition of the fender over time; and (4) to provide an aesthetically pleasing finished look to the fender.

BRIEF SUMMARY

It would be desirable to combine a heavy duty fender with an integrated fender cover in a single product. The fender of the described embodiments eliminates the need for a consumer to buy two different products to create this fendering "system," which serves the purposes of a fender cover noted above in one product. The boat fender may be manufactured with an integrated UV stabilized flocked PVC material.

In an exemplary embodiment, a boat fender includes a fender core defining a substrate that is sized and shaped for suspension adjacent a boat exterior to protect the boat exterior from damage resulting from impact with an obstacle. An adhesive is applied to at least a portion of the substrate, and a flock material is deposited on the substrate and secured by the adhesive. The fender core may be substantially cylindrical including an exterior circumferential surface and ends. The exterior circumferential surface may define the substrate, and the adhesive and the flock material may be disposed on the exterior circumferential surface or on at least a middle portion of the exterior circumferential surface. The fender core may include a vinyl material.

In another exemplary embodiment, a boat fender includes a vinyl fender core that is sized and shaped for suspension adjacent a boat exterior to protect the boat exterior from damage resulting from impact with an obstacle, and an integrated cover is secured to the fender core. The integrated cover may include a flock material that may be deposited onto the fender core. The boat fender may also include an adhesive on the fender core, where the flock material may be secured to the fender core with the adhesive. The fender core may be substantially cylindrical including an exterior circumferential surface and ends, where the adhesive and the flock material may be disposed on the exterior circumferential surface. The boat fender may further include an eyelet disposed on an end of the fender core that is sized to receive a rope for securing the boat fender to the boat. The flock material may include fiber particles.

BRIEF DESCRIPTION OF THE DRAWINGS

These and other aspects and advantages will be described in detail with reference to the accompanying drawings, in which.

DETAILED DESCRIPTION

Figure 1:
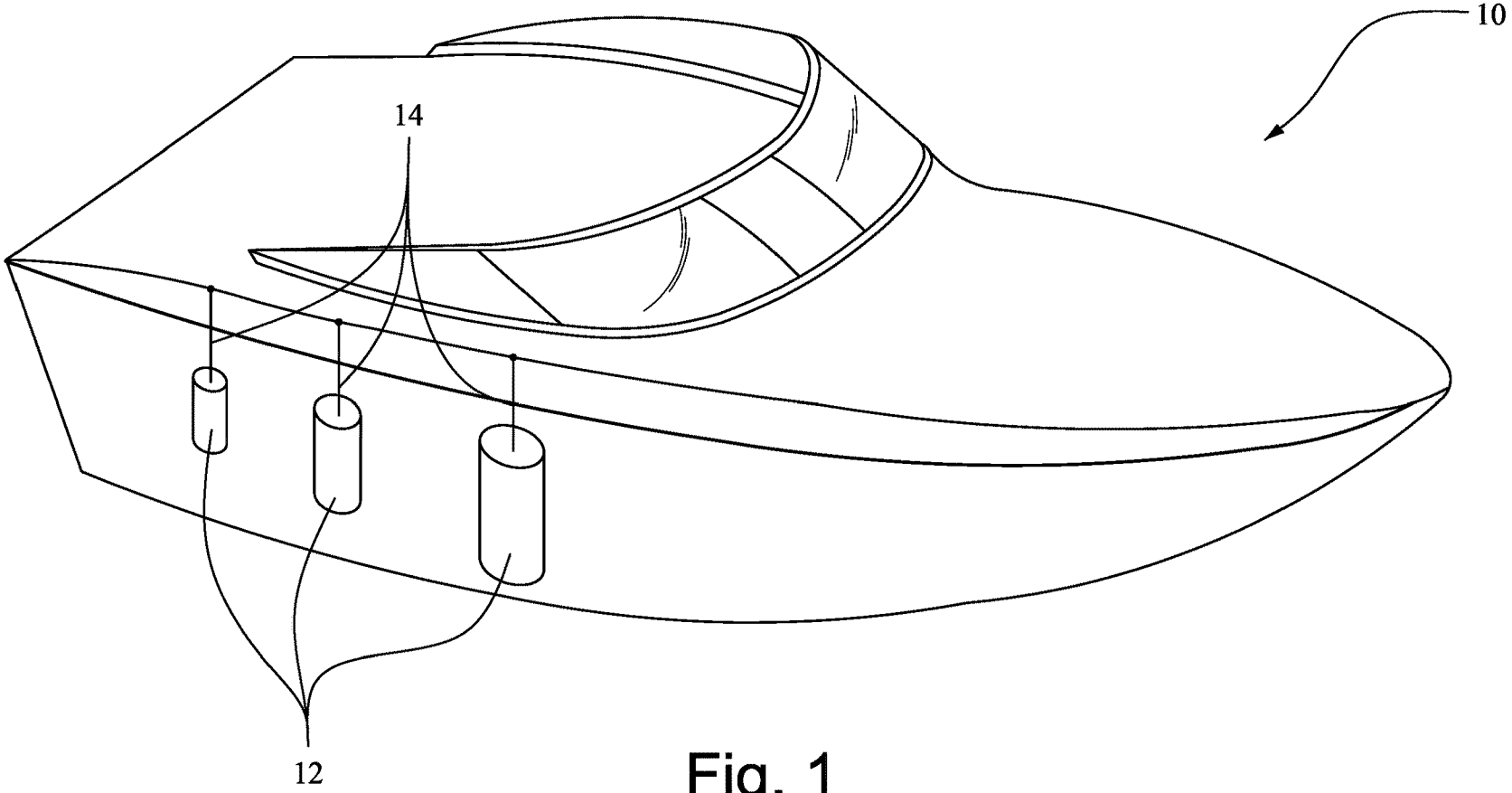
FIG. 1 shows a boat using boat fenders suspended from a boat railing.

FIG. 1 is a perspective view of a boat 10 including boat fenders 12 suspended by ropes 14 adjacent a boat exterior. Generally, the boat fenders 12 serve to protect the boat exterior from damage resulting from impact with an obstacle such as dock edges, other boats, buoys, etc. As noted, it would be desirable to combine a heavy-duty boat fender with an integrated fender cover in a single product.

Flocking is a process of depositing many small fiber particles (called flock) onto a surface. It can also refer to the texture produced by the process, or to any material used primarily for its flocked surface. Flocking of an article can be performed for the purpose of increasing its value in terms of the tactile sensation, aesthetics, color and appearance. It can also be performed for functional reasons including insulation, slip-or-grip friction, and low reflectivity. Until recently, flock material was primarily used in the construction of sleeping bags, but not for products exposed to UV for long periods of time. Another example is the soft surface applied onto the top side of air mattresses. Now that the manufacturing process has improved, it may be suitable in limited fashion for water toys and towables.

Figure 2:
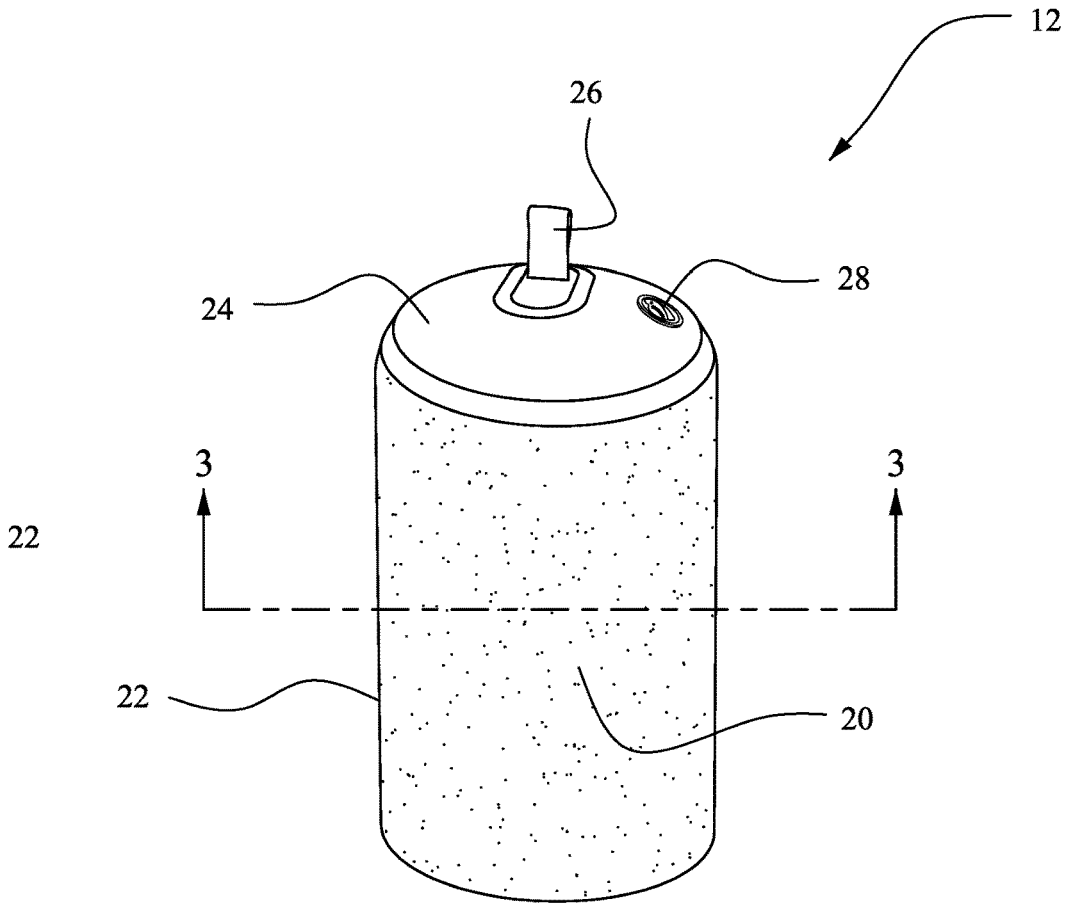
FIG. 2 is a perspective view of the boat fender according to the described embodiments.
Figure 3:
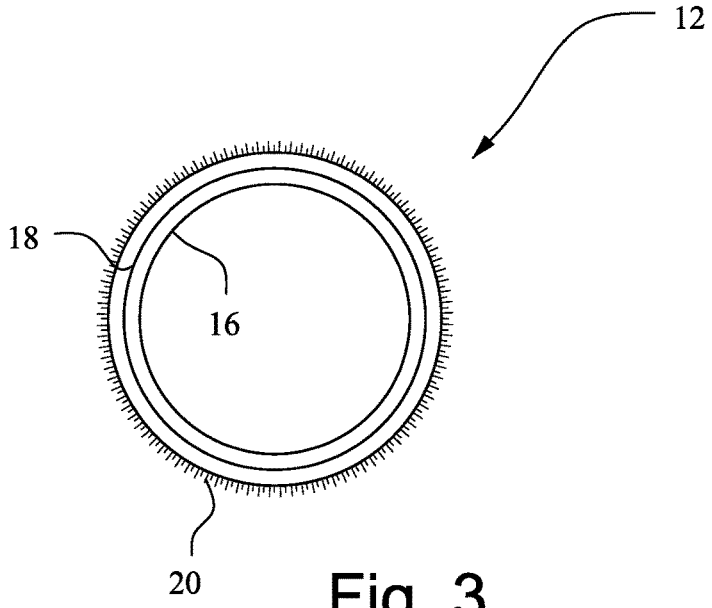
FIG. 3 is a sectional view of the boat fender along line 3-3 in FIG. 2.

FIG. 2 is a perspective view of the boat fender 12 according to preferred embodiments, and FIG. 3 is a sectional view along line 3-3 in FIG. 2. A fender core 16 serves as a substrate for the flock material. In a preferred construction, the fender core 16 is a vinyl material such as PVC or the like. An adhesive layer 18 (exaggerated in FIG. 3 for ease of illustration) is applied to the substrate 16, and a flock material 20 is deposited on the substrate 16 and secured by the adhesive 18. The flock material 20 preferably consists of fiber particles that when applied to the fender core result in a soft integrated surface on at least a portion of the exterior circumference of the boat fender 12. The manner of depositing the flock material is known and will not be described in detail.

In the exemplary construction shown in FIGS. 2 and 3, the fender core 16 is substantially cylindrical including an exterior circumferential surface 22 and ends 24. The adhesive 18 and flock material 20 are preferably disposed on at least a middle portion of the exterior circumferential surface 22, although any portion up to the entirety of the exterior circumferential surface may be covered with the flock material 20. A top end 24 of the fender 12 may be provided with a hook or eyelet or the like 26 to enable the fender 12 to be suspended from a boat by rope or the like. Additionally, at least one of the ends 24 is provided with a valve 28 as is conventional for filling and emptying the fender 12 with air or the like.

By subjecting the heavy duty fender to a flocking process, there is no need for a separate fender cover. The resulting product has a soft "flocked" outer surface that serves the purposes of the fender cover without requiring the purchase of a fender cover. The finished product results in the features and benefits of a fender with fender cover combination in one product.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A boat fender comprising:

a fender core defining a substrate, the fender core being sized and shaped for suspension adjacent a boat exterior to protect the boat exterior from damage resulting from impact with an obstacle;

an adhesive applied independently to at least a portion of the substrate;

a flock material independently deposited on the substrate and secured by the adhesive, wherein the fender core is substantially cylindrical including an exterior circumferential surface and ends, wherein the exterior circumferential surface defines the substrate, and wherein the adhesive and the flock material are disposed on the exterior circumferential surface; and an eyelet secured to at least one of the ends of the fender core, the eyelet comprising a fabric loop secured in a reinforced area formed in the at least one of the fender core ends, the reinforced area including a border surrounding a portion of the fender core end to which the eyelet is secured.

2. A boat fender according to claim 1, wherein the exterior circumferential surface defines the substrate, and wherein the adhesive and the flock material are disposed on at least a middle portion of the exterior circumferential surface.

3. A boat fender according to claim 1, wherein the fender core comprises a vinyl material.

* * * * *